US009125444B2

(12) United States Patent
Mahaney

(10) Patent No.: US 9,125,444 B2
(45) Date of Patent: Sep. 8, 2015

(54) ADJUSTABLE AIR INLET FOR CLOTHING

(71) Applicant: Augustus E. Mahaney, Manassas, VA (US)

(72) Inventor: Augustus E. Mahaney, Manassas, VA (US)

( * ) Notice: Subject to any disclaimer, the term of this patent is extended or adjusted under 35 U.S.C. 154(b) by 267 days.

(21) Appl. No.: 13/886,224

(22) Filed: May 2, 2013

(65) Prior Publication Data

US 2014/0325743 A1 Nov. 6, 2014

(51) Int. Cl.

| | |
|---|---|
| ***A41D 31/00*** | (2006.01) |
| ***A41D 13/005*** | (2006.01) |
| ***A41D 27/28*** | (2006.01) |

(52) U.S. Cl.

CPC ..... *A41D 13/0053* (2013.01); *A41D 27/28* (2013.01); *A41D 2400/20* (2013.01)

(58) Field of Classification Search

CPC ..... A41D 13/0025; A41D 27/28; A42C 5/04; Y10S 2/01

USPC ..... 2/69, 243.1, DIG. 1; 622/69, 243.1, 622/DIG. 1

See application file for complete search history.

(56) References Cited

U.S. PATENT DOCUMENTS

| | | | | |
|---|---|---|---|---|
| 3,045,243 | A | 7/1962 | Lash | |
| 4,513,451 | A | 4/1985 | Brown | |
| 4,576,087 | A | 3/1986 | Wolfe | |
| 4,722,099 | A | 2/1988 | Kratz | |
| 5,105,477 | A | 4/1992 | Golde | |
| 5,197,294 | A | 3/1993 | Galvan et al. | |
| 5,564,124 | A | 10/1996 | Elsherif et al. | |
| 6,070,274 | A * | 6/2000 | van der Sleesen | 2/456 |
| 6,085,353 | A | 7/2000 | van der Sleesen | |
| 6,442,760 | B2 | 9/2002 | Moretti | |
| D479,901 | S | 9/2003 | Brownlee | |
| 6,795,976 | B1 | 9/2004 | van der Sleesen | |
| 8,276,213 | B2 | 10/2012 | Maurer | |
| 2013/0081192 | A1 * | 4/2013 | Den Dekker et al. | 2/69 |

FOREIGN PATENT DOCUMENTS

| | | |
|---|---|---|
| EP | 320622 | 6/1989 |

OTHER PUBLICATIONS

Website, http://www.motorcyclesuperstore.com/3/11/99/52152/ITEM/River-Road-Race-Vented-Leather-Jacket.aspx?SiteID=Google_PLA99&WT.mc_ID=10012&esvt=400011-GOUSP340799086&esvq=vented%20motorcycle%20jacket&esvadt=999999-0-3978922-1&esvcrea=10199372093&esvaid=30548&kw=vented%20motorcycle%20jacket&gclid=CNT2m8DnkLUCFQJx4AodeBQArw, River Road Race Vented Leather Jacket, two sheets printed from the internet on Jan. 31, 2013.

* cited by examiner

*Primary Examiner* — Anna Kinsaul
(74) *Attorney, Agent, or Firm* — Richard C Litman

(57) ABSTRACT

The adjustable air inlet for clothing is of particular value to those wearing heavy protective clothing in warmer conditions, such as motorcyclists wearing leather protective apparel. The adjustable air inlet is installed in a passage through the clothing where it may be aligned with ambient airflow, e.g., along the forearm, upper thigh, shoulder, or on the back of a glove or on a boot. Inner and outer flanges are installed along the edges of the hole, the outer flange securing a resilient scoop over the hole. A duct is preferably provided from the trailing end of the scoop within the clothing to an area of the body that is most benefited by the airflow. The scoop is normally open, but may be closed by a latch extending from the forward part of the outer flange. A cooling insert may be installed within the scoop for additional comfort.

14 Claims, 5 Drawing Sheets

ADJUSTABLE AIR INLET FOR CLOTHING

BACKGROUND OF THE INVENTION

1. Field of the Invention

The present invention relates generally to apparel, and particularly to an adjustable air inlet for clothing to duct cooling airflow to critical areas of the body beneath the clothing.

2. Description of the Related Art

Most conscientious motorcyclists wear relatively heavy protective clothing when riding, and such protective clothing is generally a regulatory requirement in most racing and competition venues. Such protective clothing is generally manufactured of leather, since the durability of natural leather is unsurpassed for protecting the wearer from abrasion and other minor injury in the event of an accident.

A major problem with leather is that it is essentially non-porous in its natural state, and serves as a reasonably good thermal insulator as well when provided in thicknesses sufficient to provide good protection in the event of an accident. While such properties are appreciated in cooler temperatures, most motorcyclists are active during the warmer months of the year, either on the road or in racing events. Wearing a full set of "leathers," including a closed face helmet, gloves, and boots, while riding in very warm or hot temperatures, can rapidly dehydrate the motorcyclist and lead to heat exhaustion or at least greatly reduce the strength and reaction required of a motorcyclist, particularly when undergoing the exertion required in a racing event. Much the same is true of other protective clothing worn in other motorsports competition, e.g., Nomex® fire protective uniforms, etc.

As a result, various means of providing cooling to the person wearing such protective clothing have been developed in the past. A number of systems involving externally disposed cooling units, e.g., chilled water from an ice chest or refrigeration unit circulating through tubes installed within the suit, have been developed in the past. While such systems may be practicable for many automotive motorsports involving larger race cars having sufficient internal volume to carry such apparatus, they are clearly impracticable for motorcyclists, either on the street or in racing events. Simpler ventilation has been provided in helmets, jackets, and other garments, but most of these systems are either non-adjustable or require the removal or opening of some part of the garment via zippers, snaps, or other closure or attachment means. Moreover, such snap and zipper closures fail to provide any form of positive airflow inlet to duct fresh air into the garment.

Thus, an adjustable air inlet for clothing solving the aforementioned problems is desired.

SUMMARY OF THE INVENTION

The adjustable air inlet for clothing essentially comprises a forward-facing scoop, i.e., having an opening or mouth oriented in the direction of motion of the wearer, installed over a hole or air passage formed through an area of the clothing. The air inlet includes a lower or inner flange and an upper or outer flange capturing the edges of the hole or air passage of the clothing therebetween. The trailing end of the air scoop has a tab secured between the two flanges. The leading or inlet end of the scoop includes a pair of small forwardly projecting tangs that reside within cooperating channels or slots defined by the forward portions of the outer and inner flanges to secure the inlet end of the scoop to the flange assembly and clothing. This construction allows the forward end of the scoop to spread laterally as it is flattened for closure. A latch tab extends from the forward portion of the outer flange and projects rearward to engage the upper forward edge of the scoop when the scoop is pressed closed, thereby securing the scoop in a closed position. Flexure of the latch tab allows the resilient scoop to spring back to its normally open position when manipulated by the wearer of the garment.

The adjustable air inlet includes certain additional features as well. An internal duct may be provided from the trailing end of the inlet to some critical area within the clothing, e.g., from an inlet on the forearm to the armpit, from an inlet on the thigh to the groin, etc. A pre-chilled cooling insert may be removably installed within the scoop so that air is cooled as it passes through passages or channels in the insert for distribution to other areas of the body via the ducts within the clothing. A plurality of inlets may be installed in various areas of the clothing where best oriented into the oncoming airflow, e.g., on the forearm and shoulder of a jacket, on the outer thigh of a pair of pants, on the back of the hand of a glove, on the side of a boot, etc. Internal ducts within the clothing may extend to provide airflow from any of these locations to the area where cooling airflow is most needed. The size and shape of the inlets may be adjusted as desired for various areas of the clothing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The adjustable air inlet for clothing may be installed in various areas of various articles of clothing, including footwear, to enable the wearer of the clothing to adjust the airflow therethrough as desired. While the adjustable air inlet for clothing may be installed in practically any type of clothing as desired, it is particularly well suited for installation in heavy protective clothing worn when the wearer is exposed to a significant wind or airflow velocity, as in the case of a motorcyclist or the like.

Figure 1:
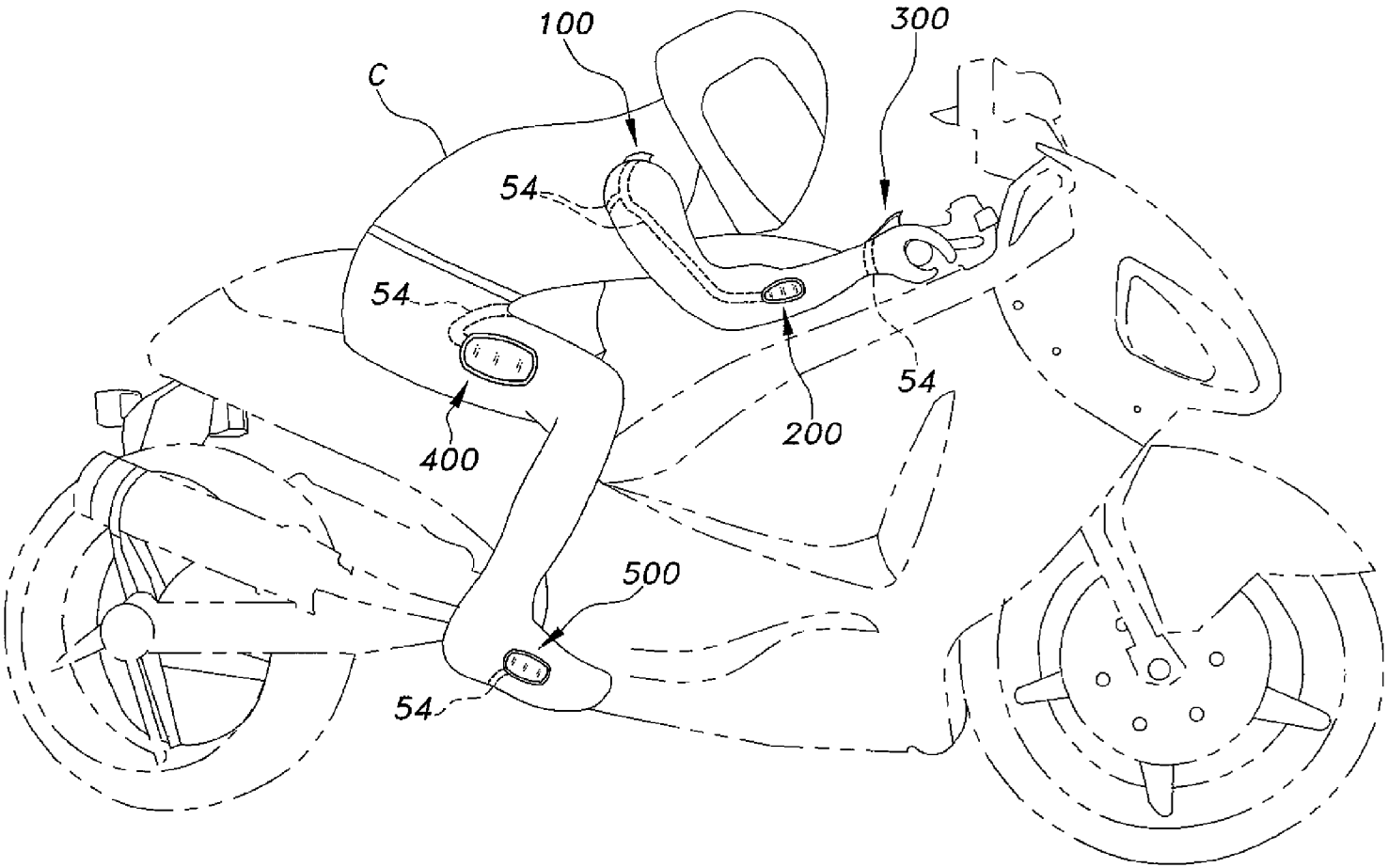
FIG. 1 is an environmental perspective view of a plurality of adjustable air inlets for clothing according to the present invention, the adjustable air inlets being shown on the protective apparel of a motorcyclist on a motorcycle.

FIG. 1 is an illustration of a motorcyclist wearing protective clothing C with a number of adjustable air inlets installed therein. The various adjustable air inlets comprise a shoulder inlet 100, a forearm inlet 200, a glove inlet 300, a thigh inlet 400, and a foot or boot inlet 500. Each of the inlets 100 through 500 is formed and constructed in much the same manner, but their relative sizes may be adjusted as desired to suit the location of the installation. Other adjustable air inlets, not shown, may be installed in other areas of the clothing in addition to or in lieu of one or more of those inlets 100 through 500 illustrated in FIG. 1.

Figure 2:
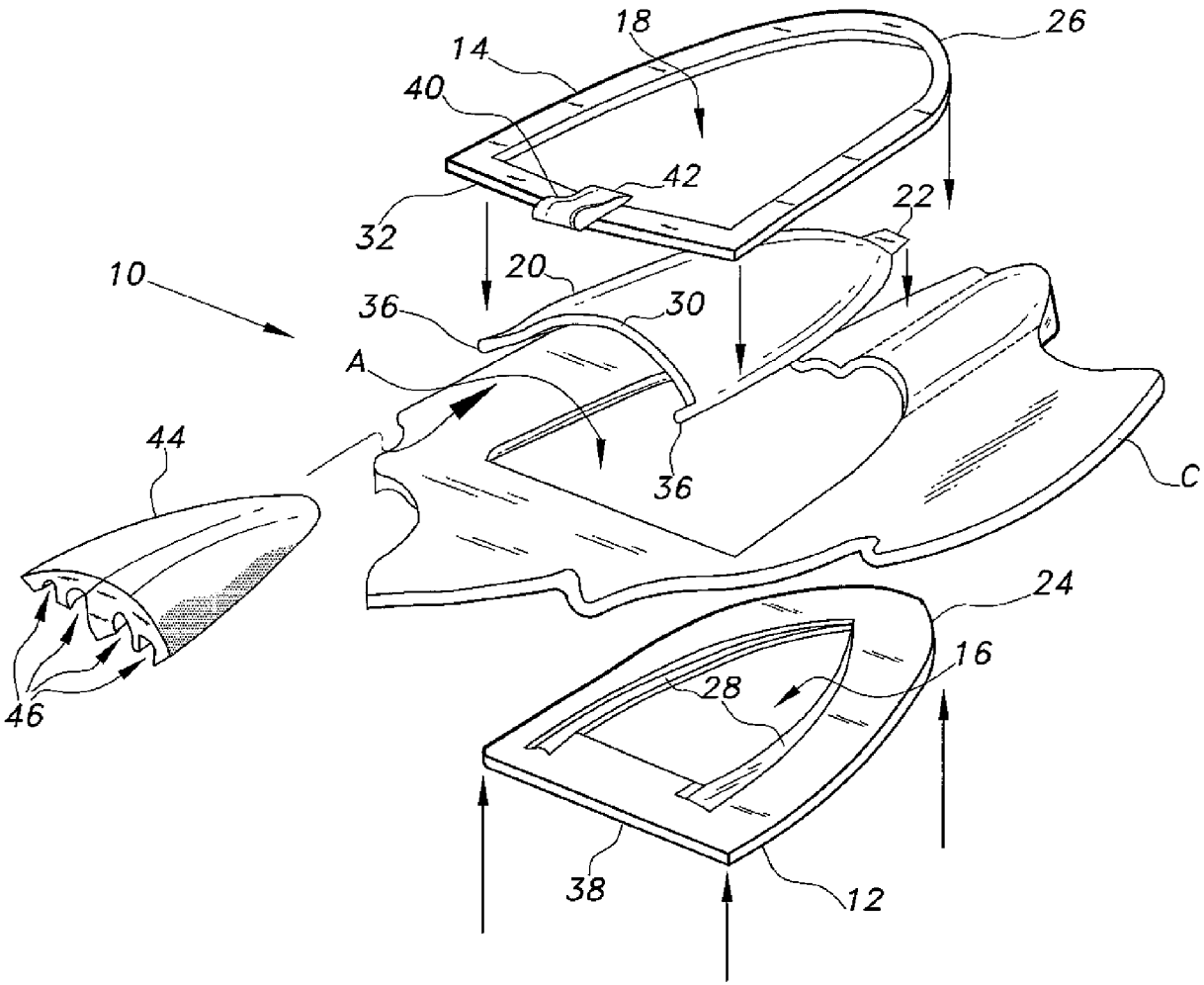
FIG. 2 is an exploded perspective view of an exemplary adjustable air inlet for clothing according to the present invention, illustrating various details thereof.

FIG. 2 provides an exploded perspective view of an exemplary adjustable air inlet 10. The structure of the air inlet 10 may be used to form any of the air inlets 100 through 500 shown in FIG. 1 or others similar thereto, the scale being adjusted according to the area of installation on the clothing C. The air inlet 10 comprises an inner flange 12 and an outer flange 14 that secure respectively to the inner and outer surfaces of an article of clothing C. A broken away portion of the clothing is shown in FIG. 2. The clothing C (e.g., jacket, pants, glove, boot or shoe, etc.) is modified by forming an air passage A therethrough. The inner and outer flanges 12 and 14 have respective air passages 16 and 18 formed therethrough that are substantially aligned with the air passage A through the article of clothing C to which the flanges 12 and 14 are attached.

An air scoop 20 is installed across the air passage A of the clothing C. The scoop 20 is captured between the inner and outer flanges 12 and 14. The scoop 20 has a tab 22 that is sewn or otherwise secured between the corresponding rearward ends 24 and 26 of the two flanges 12 and 14, i.e., the ends that are oriented downwind during normal use of the clothing C with its adjustable air inlet(s). The remaining periphery of the scoop 20 is loosely captured between the two flanges 12 and 14 and the periphery of the air passage A through the article of clothing C in order to allow the scoop 20 to flex for opening and closure, as described further below. The scoop 20 is preferably formed of a flexible and resilient, but not flaccid, sheet of material, such as a moderately thin sheet of plastic or the like. The material should have a flexibility on the order of that found in a conventional plastic lid typically provided for the closure of coffee cans and the like, i.e., sufficiently rigid to hold its free shape, but sufficiently flexible as to allow flexure when moderate force is applied thereto to deform and retain the scoop 20 in other than an open position.

Figure 3:
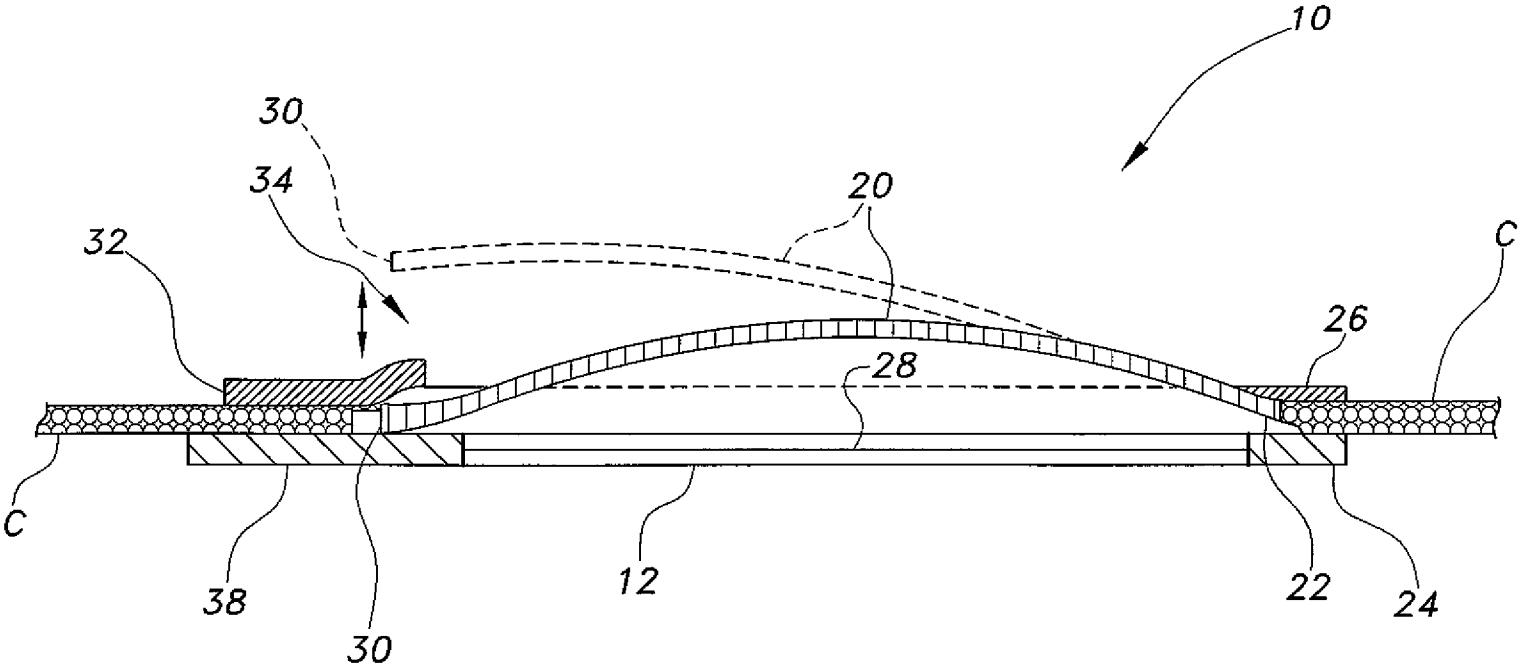
FIG. 3 is a left side elevation view in section of an exemplary adjustable air inlet for clothing according to the present invention, illustrating the selective closure latch for the inlet scoop.
Figure 4:
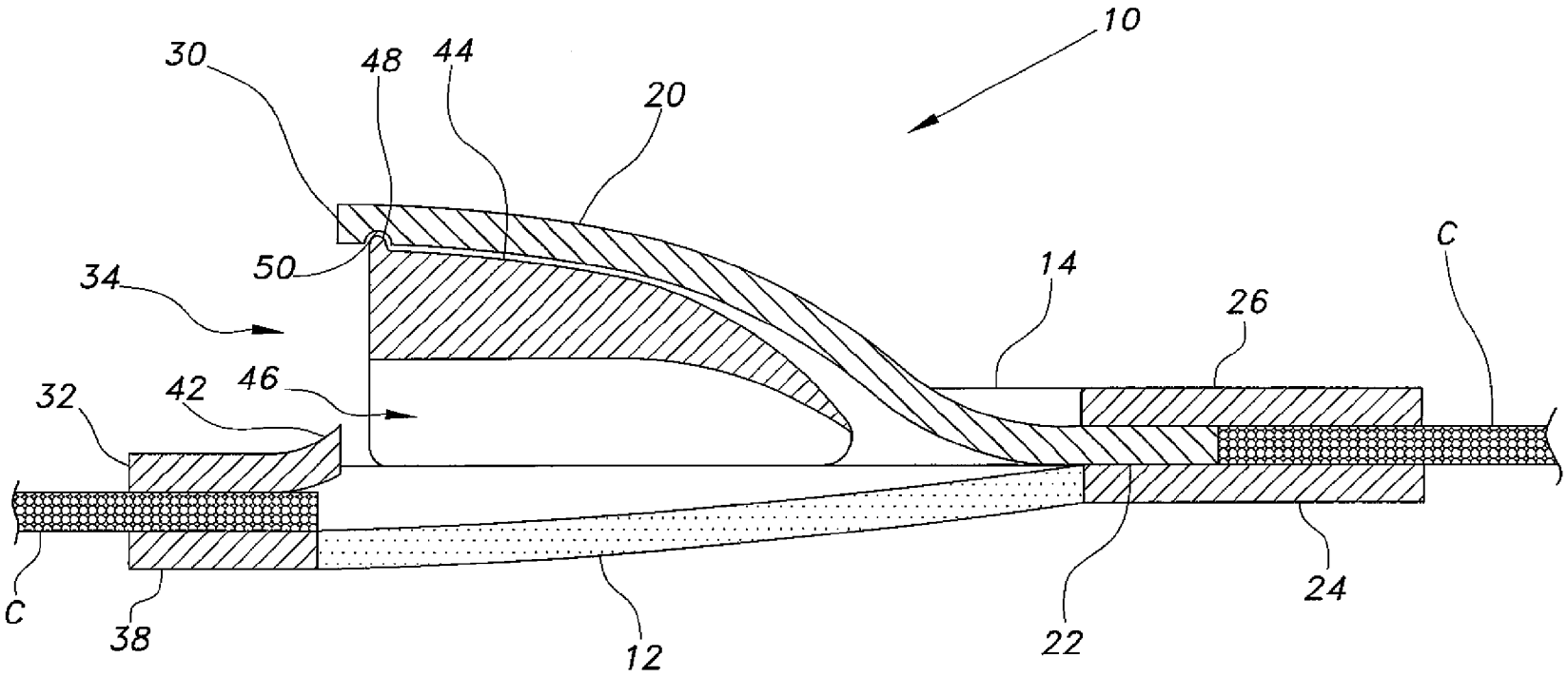
FIG. 4 is a left side elevation view in section of an exemplary adjustable air inlet for clothing according to the present invention, illustrating the retention system for an air cooling insert removably placed within the scoop.
Figure 5:
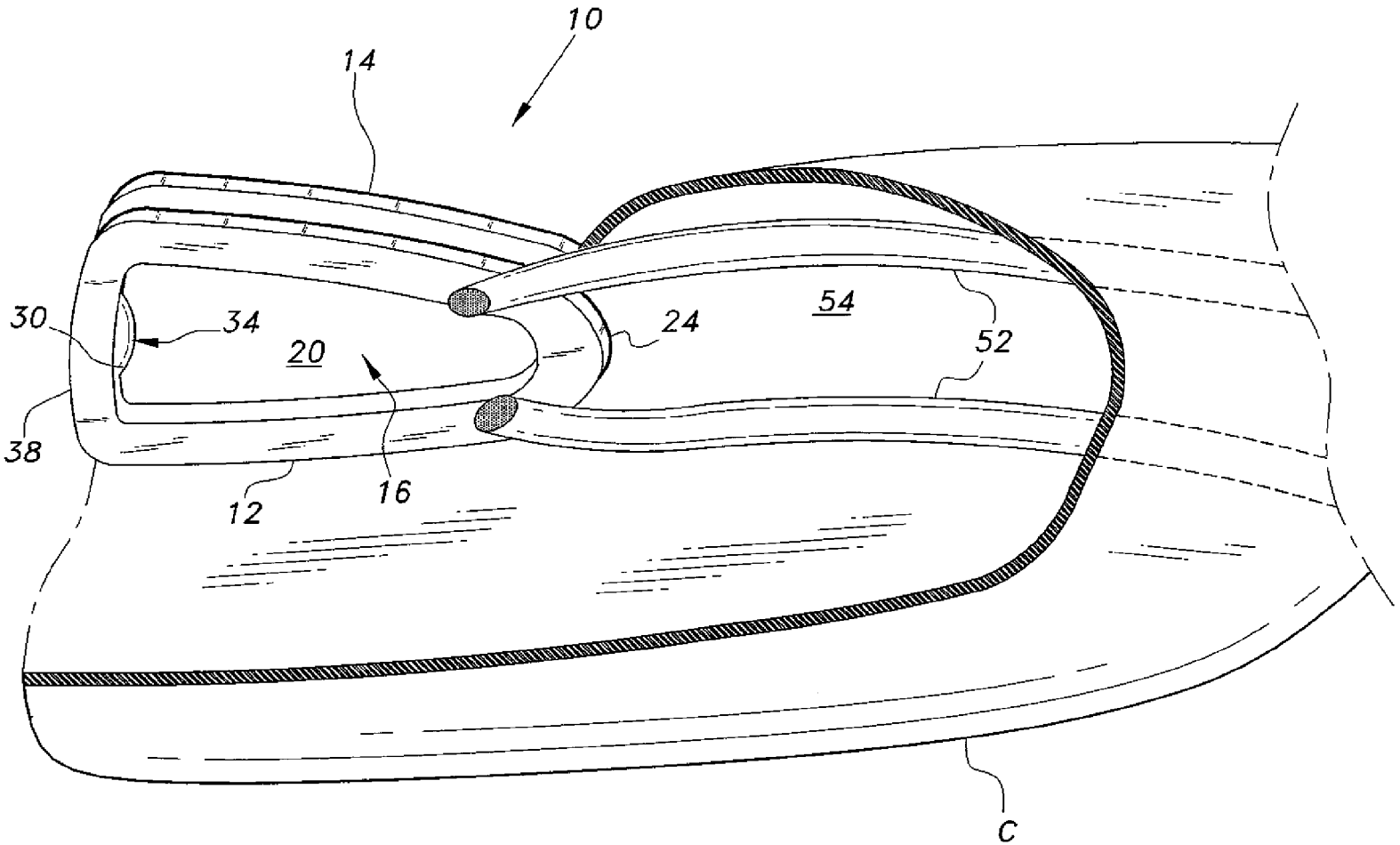
FIG. 5 is a bottom perspective view of the adjustable air inlet for clothing according to the present invention, showing the device installed in an article of clothing, a portion of the clothing being broken away to illustrate an air channel formed within the article of clothing for ducting airflow to other areas within the clothing.

The inner flange 12 includes a relief 28 formed along each lateral edge thereof to allow for lateral spreading of the scoop 20 when it is closed. The width of the air inlet passage A through the clothing C is formed to allow clearance for the spreading of the scoop 20. The forward or leading edge or end 30 of the scoop 20 is normally arched or bowed upwardly, generally as shown in FIG. 2 and as shown in broken lines in FIG. 3. The normally upwardly arched leading edge 30 and the forward or leading edge or end portion 32 of the outer flange 14 define an air inlet 34 therebetween, as shown in FIGS. 3 through 5. As the forward end or edge 30 of the scoop 20 is pushed downward, i.e., toward the forward portion 32 of the outer flange 14, the two lateral edges of the scoop 20 spread laterally into the reliefs 28 of the inner flange 12. The air passage A through the clothing C may be made sufficiently wide as to provide further clearance for the lateral spreading of the scoop 20, the outer flange 14 retaining the lateral edges of the scoop 20, whether spread or raised.

The scoop 20 further includes laterally opposed forward extensions 36 that reside within forward extensions of the lateral reliefs 28 of the inner flange 12. These forward extensions of the scoop 20 are free to move laterally in the two forward relief extensions formed in the forward portion 38 of the inner flange 12. The forward portion 32 of the outer flange 14 is disposed over the forward extensions 36 of the scoop 20 to prevent the forward end or edge 30 of the scoop 20 from escaping its capture between the two flanges 12 and 14.

A latch mechanism is provided to hold the leading edge 30 of the scoop 20 closed as desired. The latch is shown particularly in FIG. 3. The latch 40 may comprise a flexible tab attached atop the forward portion 32 of the outer flange 14, as shown in FIG. 2, or may merely comprise a rearward extension formed homogeneously with the forward portion 32 of the flexible (e.g., plastic, etc.) outer flange 14. In any case, the latch includes a rearward extension 42 that extends slightly over or into the forwardmost portion of the air passage 18 of the outer flange 14. This extension 42 is configured to interfere with the leading edge 30 of the air scoop 20 when the scoop 20 is flexed past the latch extension 42, generally as shown in FIG. 3. The scoop 20 is normally open and its leading edge 30 is raised, generally as shown in broken lines in FIG. 3. The leading edge 30 of the scoop 20 is captured and secured by the latch extension 42 by pushing downward on the leading edge of the scoop, causing it to push past the latch extension 42 to be secured in its closed position as shown in solid lines in FIG. 3. The forward portions 32 and 38 of the two flexible flanges 12 and 14, along with the portion of the clothing C captured therebetween, may be flexed forward and downward to cause the latch extension 42 to flex upward, thereby releasing the forward or leading edge 30 of the scoop 20 to its open position, as shown in broken lines in FIG. 3. This latch configuration provides for very rapid and easy opening and closing of the air scoop 20 using only one or two fingers on one hand. This rapid and easy manipulation of the latch and scoop are useful when riding a motorcycle or engaged in many other activities where wearing a suit equipped with the present adjustable air inlets may be required.

FIG. 4 provides a side elevation view in section illustrating an additional component that may be used with the adjustable air inlet 10. A cooling insert 44, also shown in FIG. 2, may be removably installed within the open scoop 20. The cooling insert 44 comprises a block of material having a shape that closely approximates the interior volume of the open scoop 20 in order to maximize the volume of the insert 44. The cooling insert 44 is preferably formed of a material having a relatively high specific heat in order that it may be chilled to absorb heat from the air passing therethrough. Alternatively, the cooling insert 44 may be hollow, and may be filled with water (or other freezable material) and frozen prior to use to provide the desired cooling effect. The cooling insert includes several air channels or passages 46 therethrough to allow air to flow through the channels and contact a fair amount of surface area of the insert 44 to cool the air. The cooling insert 44 may be removably retained within the open scoop 20 by an upward lip 48 extending from the forward portion of the insert 44. The lip 48 engages a cooperating channel 50 formed within the forward or leading edge 30 of the flexible scoop 20, generally as shown in FIG. 4.

FIG. 5 illustrates an exemplary means for channeling the airflow from the adjustable air inlet 10 to other portions of the clothing C. FIG. 5 illustrates a closed sleeve, leg, etc., of an article of clothing C. A portion of the sleeve is broken away to show the interior of the sleeve. In the example of FIG. 5, a pair of elongate resilient members 52, e.g., foam, soft plastic, etc., is installed along the inner surface of the clothing C from the rearward or trailing end of the air scoop 20 to extend to an area where cooling airflow is most desired, e.g., the underarm, groin, etc. The two elongate members 52 are laterally spaced from one another to define an air duct 54 therebetween. The air duct 54 extends to the location of the distal ends of the two members 52. Returning to FIG. 1, a plurality of such air ducts 54 are shown in broken lines extending from their respective air inlets 100 through 500 to deliver cooling airflow to the underarm (from the inlets 100 and 200), palm of the hand (from the glove mounted inlet 300), crotch or groin (from the thigh mounted inlet 400), and sole of the foot (from the boot mounted inlet 500). It will be seen that other means of forming the air duct 54 may be provided in lieu of the two resilient members 52, e.g., gathering the inner liner material of the clothing C to form elongate ridges, etc.

The adjustable air inlet 10 in its various embodiments may be provided as a separate kit of one or more inlets for the owner of the clothing C to install in various locations within the clothing C as desired, or may be installed at the time of manufacture of the clothing C for a consumer to purchase with the inlets already installed, as is done in the case of ventilated helmets and the like. It will be seen that the adjustable air inlets in their various embodiments may be provided with separate articles of clothing, e.g., jackets, pants, gloves, etc., or may be provided with one piece jumpsuit-like articles wherein the upper and lower portions of the clothing are assembled as a complete and inseparable assembly. In either case, the adjustable air inlets will provide a much appreciated means of delivering cooling airflow to various areas of the body for a person clothed in such protective clothing C.

It is to be understood that the present invention is not limited to the embodiments described above, but encompasses any and all embodiments within the scope of the following claims.

I claim:

1. An adjustable air inlet for clothing, the clothing having at least one air passage formed therethrough, the adjustable air inlet comprising:

a flange component adapted for being disposed about the at least one air passage of the clothing, the flange component having a forward portion and a rearward portion opposite the forward portion, the flange component comprises an inner flange and an outer flange, each of the flanges having a forward portion and a rearward portion opposite the forward portion;

an air scoop secured to the clothing by the flange component, the air scoop being formed of a flexible material, the air scoop having a forward edge defining an opening and a rearward end opposite the forward edge, the inner flange and the outer flange being adapted for capturing the forward edge of the air scoop therebetween;

a tab extending rearward from the rearward end of the scoop, the tab being captured between the rearward portions of the inner flange and the outer flange and securing the scoop to both of the flanges and to the clothing; and a latch extending rearward from the forward portion of the flange component, the latch selectively engaging the forward edge of the air scoop for selectively closing the air scoop.

2. The adjustable air inlet for clothing according to claim 1, further comprising a cooling insert removably disposed within the air scoop.

3. The adjustable air inlet for clothing according to claim 2, wherein the cooling insert includes at least one air passage formed therethrough.

4. The adjustable air inlet for clothing according to claim 1, further comprising an air duct adapted for being disposed within the clothing, the air duct extending from the rearward end of the air scoop to a selected area within the clothing.

5. The adjustable air inlet for clothing according to claim 1, wherein:

at least the outer flange is formed of a flexible material; and the latch is formed as an integral, homogeneous portion of the outer flange.

6. The adjustable air inlet for clothing according to claim 1, further comprising an article of clothing in combination therewith.

7. An adjustable air inlet for clothing, the clothing having at least one air passage formed therethrough, the adjustable air inlet comprising:

an inner flange adapted for being disposed about the at least one air passage of the clothing;

an outer flange adapted for being disposed about the at least one air passage of the clothing, each of the flanges having a forward portion and a rearward portion opposite the forward portion;

an air scoop formed of a flexible material, the scoop having a forward edge defining an opening and a rearward end opposite the forward edge, wherein the forward edge is captured between the inner and outer flanges; and a tab extending rearward from the rearward end of the scoop, the tab being captured between the rearward portions of the inner flange and the outer flange and securing the scoop to both of the flanges and to the clothing.

8. The adjustable air inlet for clothing according to claim 7, further comprising a latch extending rearward from the forward portion of the outer flange, the latch selectively engaging the forward edge of the air scoop for selectively closing the air scoop.

9. An adjustable air inlet for clothing, the clothing having at least one air passage formed therethrough, comprising:

a flange component adapted for being disposed about the at least one air passage of the clothing, the flange component having a forward portion and a rearward portion opposite the forward portion, the flange component comprises an inner flange and an outer flange, each of the flanges having a forward portion and a rearward portion opposite the forward portion;

an air scoop secured to the clothing by the flange component, the air scoop being formed of a flexible material, the air scoop having a forward edge defining an opening and a rearward end opposite the forward edge, the forward edge of the air scoop being captured between the inner and outer flanges;

a tab extending rearward from the rearward end of the scoop, the tab being captured between the rearward portions of the inner flange and the outer flange and securing the scoop to both of the flanges and to the clothing; and a cooling insert removably disposed within the air scoop, the cooling insert including at least one air passage formed therethrough.

10. The adjustable air inlet for clothing according to claim 9, further comprising an air duct adapted for being disposed within the clothing, the air duct extending from the rearward end of the air scoop to a selected area within the clothing.

11. The adjustable air inlet for clothing according to claim 9, further comprising an article of clothing in combination therewith.

12. The adjustable air inlet for clothing according to claim 1, wherein the air scoop is formed of resilient material.

13. The adjustable air inlet for clothing according to claim 7, wherein the air scoop is formed of resilient material.

14. The adjustable air inlet for clothing according to claim 8, wherein:

the latch is formed as an integral, homogeneous portion of the outer flange.

* * * * *